US005617680A

United States Patent [19]

Beatty

[11] Patent Number: 5,617,680

[45] Date of Patent: Apr. 8, 1997

[54] MOUNTING STRUCTURE FOR A SATELLITE DISH

[76] Inventor: Douglas Beatty, 3893 Glengrove Way, San Jose, Calif. 95121

[21] Appl. No.: 278,308

[22] Filed: Jul. 21, 1994

[51] Int. Cl.[6] ..... H01Q 1/12

[52] U.S. Cl. ..... 52/27; 52/712; 52/737.6; 248/300; 248/674; 343/878; 343/879; 343/885; 343/886; 343/890; 343/892

[58] Field of Search ..... 52/27, 737.6, 712; 248/300, 674; 343/878, 879, 885, 886, 890, 892

[56] References Cited

U.S. PATENT DOCUMENTS

| | | | |
|---|---|---|---|
| 3,278,149 | 10/1966 | Brucker | 248/300 X |
| 3,284,971 | 11/1966 | Attwood | 52/737.6 X |
| 3,332,650 | 7/1967 | Judge | 248/300 X |
| 3,373,432 | 3/1968 | Breneman | 343/890 |
| 4,510,502 | 4/1985 | Hovland et al. | 52/27 X |
| 4,723,128 | 2/1988 | Gasque, Jr. | 343/885 X |
| 4,799,067 | 1/1989 | Tekip et al. | 343/890 |
| 5,273,246 | 12/1993 | Stahara et al. | 248/300 X |

FOREIGN PATENT DOCUMENTS

| | | | |
|---|---|---|---|
| 3142957 | 6/1982 | Germany | 343/878 |

*Primary Examiner*—Christopher Todd Kent

*Attorney, Agent, or Firm*—Skjerven, Morrill, MacPherson, Franklin & Friel; Alan H. MacPherson; Omkar K. Suryadevara

[57] ABSTRACT

A satellite dish is mounted on a bracket which in turn is mounted over an uneven surface of a roof or a wall of a house. The bracket has an elevated bridge portion for supporting a mounting foot of the satellite dish. The bridge portion is integrally connected to and supported by two narrow leg portions which in turn are integrally connected to and supported by two narrow foot portions. The bridge portion is elevated from two foot portions by the leg portions in order to clear the uneven surface of the roof or wall of the house.

21 Claims, 3 Drawing Sheets

MOUNTING STRUCTURE FOR A SATELLITE DISH

FIELD OF THE INVENTION

This invention generally relates to mounting structures for a satellite dish and in particular to a mounting structure for mounting a small satellite dish on an uneven surface of a wall or roof of a house.

BACKGROUND OF THE INVENTION

FIG. 1 illustrates a small satellite dish 100 mounted on a wall 11 of a house 10 (house 10 is not completely shown for clarity). Satellite dish 100 includes a dish body 101 attached to a dish support 102 which is rotatably mounted on mounting tube 103 which in turn is supported on a mounting foot 104. Satellite dish 100 has a dish body 101 having a small diameter D=18 inches, such as the satellite dish called Digital Satellite System (DSS™) manufactured by Thompson Electronics, under the RCA brand name.

Satellite dish 100 is mounted directly on a south facing wall or on a chimney or a pole. Mounting foot 104 (FIG. 1) has a footprint surface 105 which is a rectangular flat hard surface of an area 7 inches by 5 inches. Mounting foot 104 is designed to be lag bolted through a flat, smooth, rigid wall or roof to a single stud via two center holes (not shown). The wall or roof stud on which mounting foot 104 has been attached must be sufficiently strong to withstand up to approximately 200 pounds of weight and wind forces. In addition to the two center holes, mounting foot 104 also has four outer holes for bolts used to stabilize satellite dish 100.

Being mountable on a flat surface, satellite dish 100 cannot be mounted on a wall or roof which has an uneven surface, such as wood shake roofs, aluminum siding walls, vinyl siding walls and textured walls. In such cases, satellite dish 100 can be mounted on a ground pole, or a chimney. Furthermore, satellite dish 100 must be mounted in some cases in the front portion of a house, to ensure that dish body 101 faces the southern direction, towards the equator, for receiving signals from an equatorial satellite, for example, a satellite located at 105 longitude at the equator.

SUMMARY OF THE INVENTION

In accordance with this invention, a small satellite dish is supported by a bracket, wherein the bracket is supported by a portion of a house. The bracket includes two foot portions supported by the roof of the house, two leg portions each integrally connected to the two foot portions, and a bridge portion integrally connected between the two leg portions. The bridge portion is at an elevated position with respect to the foot portions and has a flat, smooth, rigid surface for receiving a mounting foot of the satellite dish. Each of the two foot portions is supportable by a separate roof eave stud, so that the load on the satellite dish can be shared by two roof eave studs. The foot portions have a width sufficiently small so that the foot portions are easily mounted on an uneven surface of a roof or wall of a house. The bridge portion is elevated from the two foot portions by a sufficient distance to clear any uneven surfaces. Once the bracket is mounted to the wall or roof of a house, the mounting foot of a satellite dish is mounted on the bridge portion of the bracket, thus completing the mounting of the satellite dish on the roof.

Therefore, a bracket in accordance with this invention allows a satellite dish to be mounted on a roof eave with an uneven surface and alternatively on a south facing wall having an uneven surface such as stucco, aluminum siding, vinyl siding and a textured surface. If a south facing wall is not available or happens to be in the front of a house, the satellite dish can be mounted on the rear portion of a roof with the bracket in accordance with this invention. Furthermore, the bracket provides increased strength and stability because the two foot portions of the bracket are supported by two studs of a house. The bracket in accordance with this invention is inexpensive to produce because it can be entirely machine made. Moreover the bracket has a shape which allows the bracket to be easily stacked on other identical brackets for compact storage and shipment. A user can easily install the bracket using standard tools and materials available in a hardware store.

DETAILED DESCRIPTION

According to the principles of this invention, a satellite dish is supported by a bracket mounted on a house. The bracket has two narrow foot portions mounted on the roof or wall of the house, two leg portions integrally connected to the foot portions and a flat rigid bridge portion integrally connected between the two leg portions. The bridge portion is elevated from the two foot portions by the leg portions in order to clear any uneven surfaces of the wall or roof on which the foot portions are mounted. The mounting foot of the satellite dish is mounted on the bridge portion of the bracket. Each foot portion is supported by a roof eave stud so that the load on the satellite dish is shared by two roof eave studs.

Figure 1:
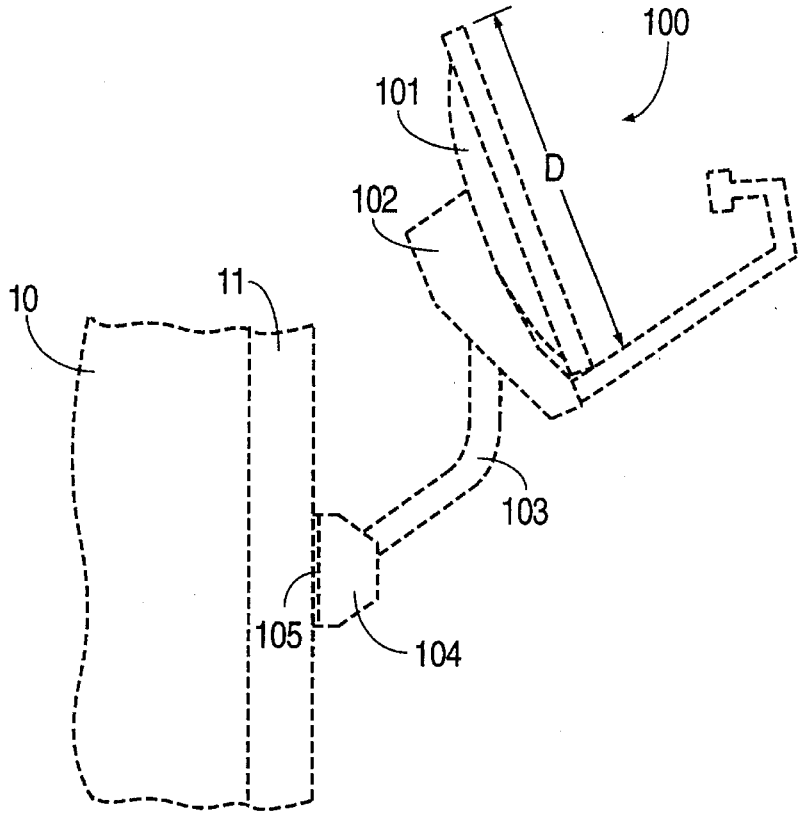
FIG. 1 (Prior Art)
FIG. 1 illustrates a prior art wall mounting of a small satellite dish.
Figure 2:
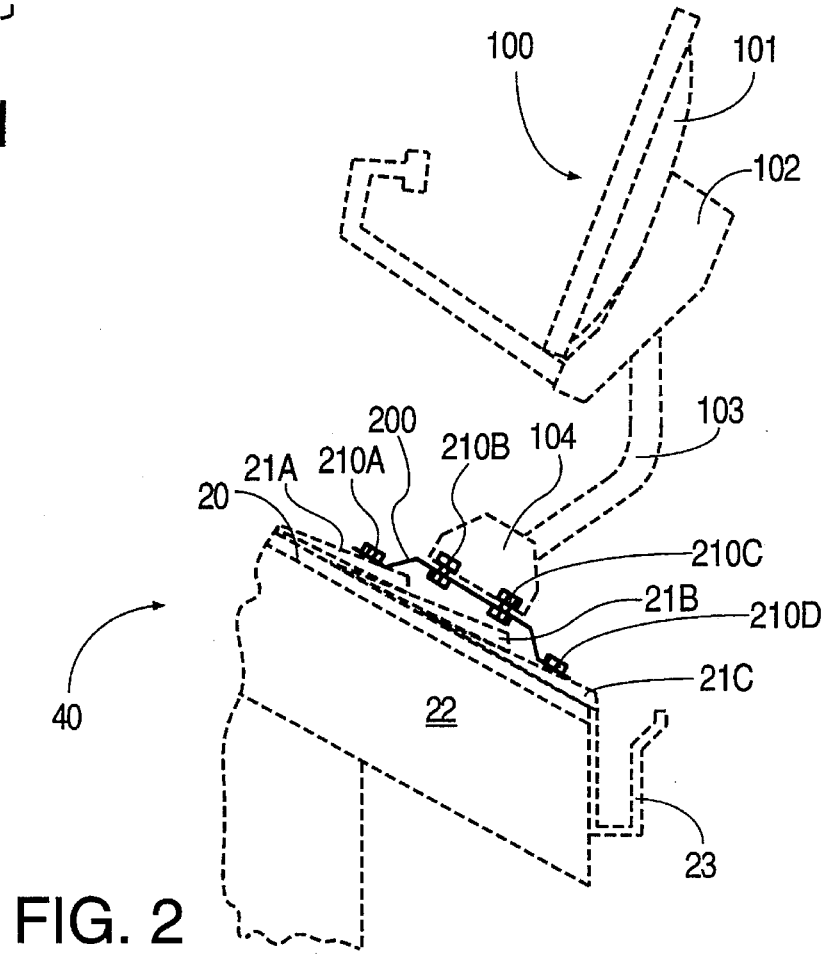
FIG. 2 illustrates a small satellite dish supported by a bracket mounted on the roof of a house in accordance with this invention.

FIG. 2 illustrates a satellite dish 100 supported by a bracket 200 mounted on roof 20 of a house 40 in accordance with this invention. House 40 includes standard house roof eave studs 22, gutter 23 as well as roof shingles 21A, 21B, and 21C.

Figure 3B:
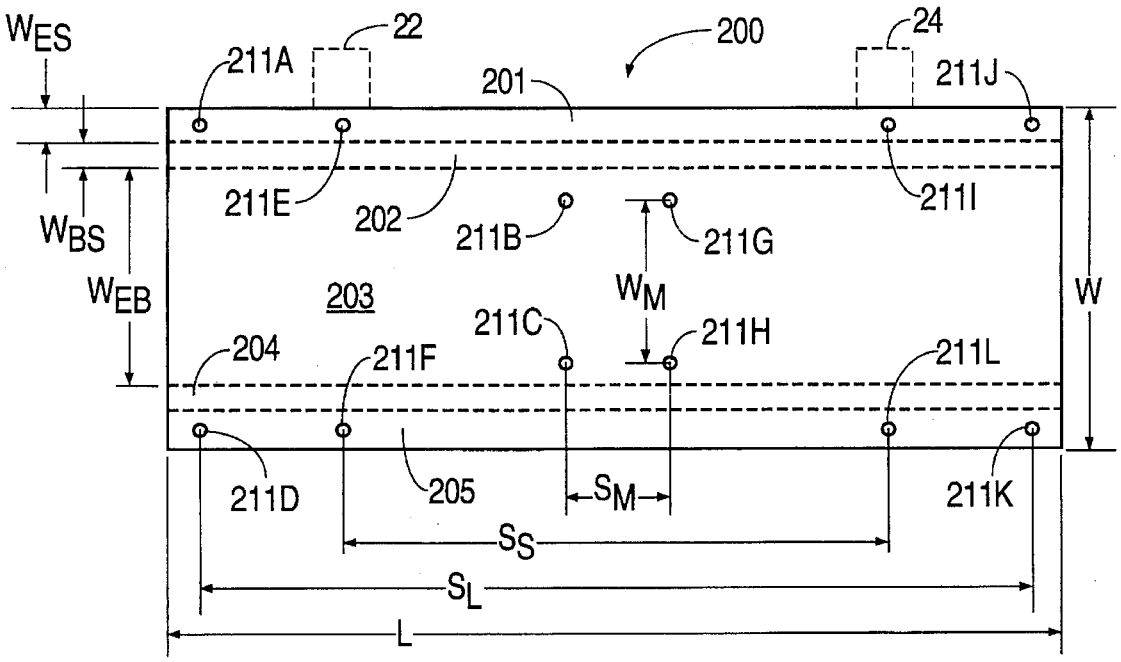
FIGS. 3A and 3B illustrate a side view and a front elevation view of the bracket shown in FIG. 2.
Figure 3A:
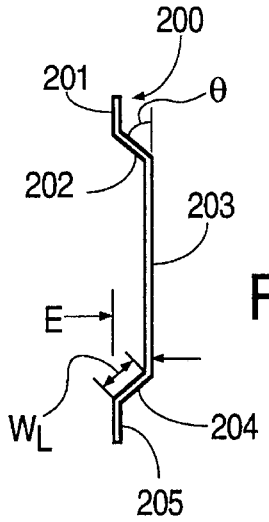
Figure 3C:
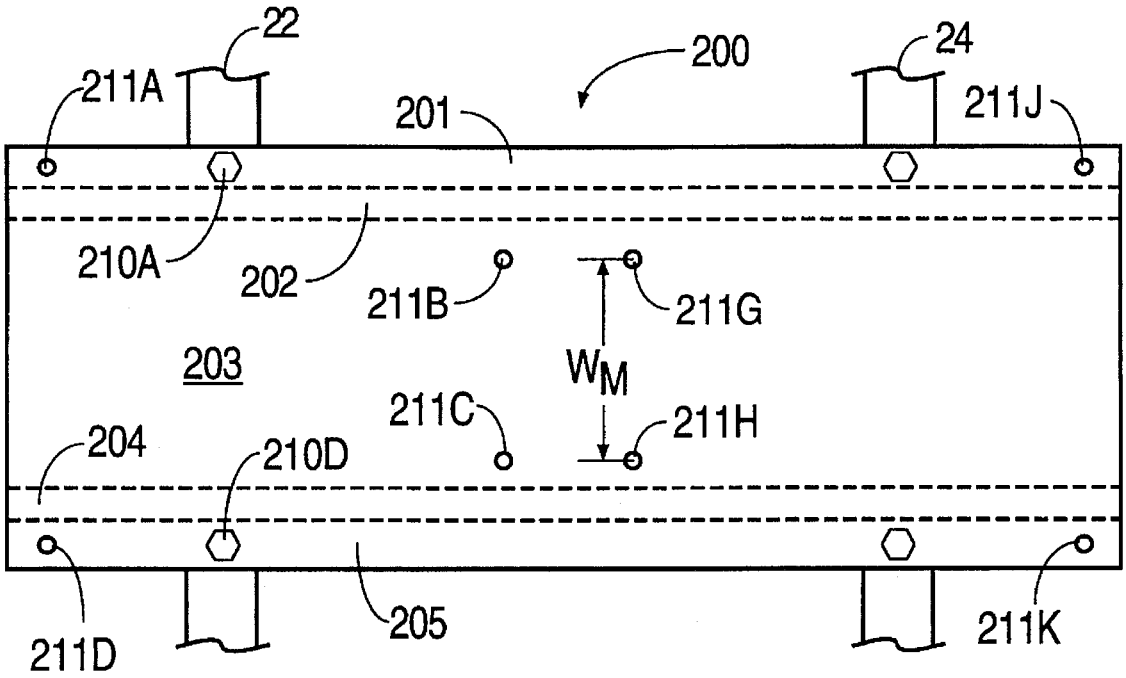
FIG. 3C illustrates, in a front elevation view, the bracket of FIG. 3B mounted on the roof of FIG. 2.

FIGS. 3A, 3B and 3C illustrate a side view and a front elevation view of bracket 200 of FIG. 2. Bracket 200 has two narrow foot portions 201 and 205 and two narrow leg portions 202 and 204. Leg portions 202 and 204 are integrally connected to and supported by foot portions 201 and 205. Bracket 200 also has a flat, rectangular, rigid bridge portion 203 integrally connected and supported by leg portions 202 and 204. Bridge portion 203 is at an elevated position with respect to foot portions 201 and 205 such that the elevation distance E=1 inch in one embodiment, which is sufficient for bridge portion 203 to clear shingles on a roof surface of a standard house, such as shingles 21A and 21B (FIG. 2), when foot portions 201 and 205 are mounted on roof 20.

In one specific embodiment of this invention, leg portions 202 and 204 are at an angle θ=45° measured from the plane of bridge portion 203. Foot portions 201 and 205 have a width $W_{ES}$=1 inch, leg portions 202 and 204 have a width $W_L$ of 1.4 inch (FIG. 3A) so that folded width $W_{BS}$=1 inch (FIG. 3B), and bridge portion 203 has a width $W_{EB}$=7 inches. In the center of bridge portion 203 are four mounting holes 211B, 211C, 211G and 211H which are arranged at the corners of a rectangle with sides $S_M$=3 and ¾ths of an inch and $W_M$=6 and 1/16 inch. Mounting holes 211B, 211G, 211C and 211H match corresponding outer holes in mounting foot 104 of satellite dish 100 so as to receive bolts which attach mounting foot 104 to bracket 200. For example, bolts 210B and 210C (FIG. 2) are received by holes 211B and 211C, respectively. Foot portions 201 and 205 of bracket 200 also have stud support holes 211A, 211E, 211I, 211J and 211D, 211F, 211L, and 211K, respectively. Each of stud support hole pairs 211E, 211I as well as 211F, 211L are separated from each other by a distance $S_S$=16 inches allowing bracket 200 to be supported by two roof eave studs 22 and 24 (FIG. 3B) separated by 16 inches, a common stud spacing in a standard house. Stud support hole pairs 211A, 211J as well as 211D, 211K are separated by a distance $S_L$=24 inches to permit bracket 200 to be mounted on two studs separated by 24 inches.

Bracket 200 has a width W=11 inches approximately, a length L=26 inches approximately and is formed of 3/32 inch thick, 12 inch wide sheet of flat ASTM A570 Grade 33 steel punched for ⅜ths inch bolt holes and folded to form the bracket's cross-sectional shape.

The user can easily install bracket 200 on a roof 20 of a house 40 by using bolts such as bolt 210A and 210D to attach the foot portions 201 and 205 through shingles 21A and 21C to roof studs such as studs 22 and 24. Although only two bolts 210A and 210D are shown in FIG. 2, two additional bolts (not visible in FIG. 2) are also used to attach bracket 200 to roof 20. Holes in shingles 21A and 21C are then sealed using roof tar to avoid leakage of water through the holes in the shingles. Placing bracket 200 on that portion of the roof over the eaves avoids water leaking into the house or building should the holes leak. Once satellite dish 100 is mounted on roof 20 of house 40, dish body 101 is rotated around mounting pole 103 to point dish body 101 at an equatorial satellite in the southern direction.

Figure 4:
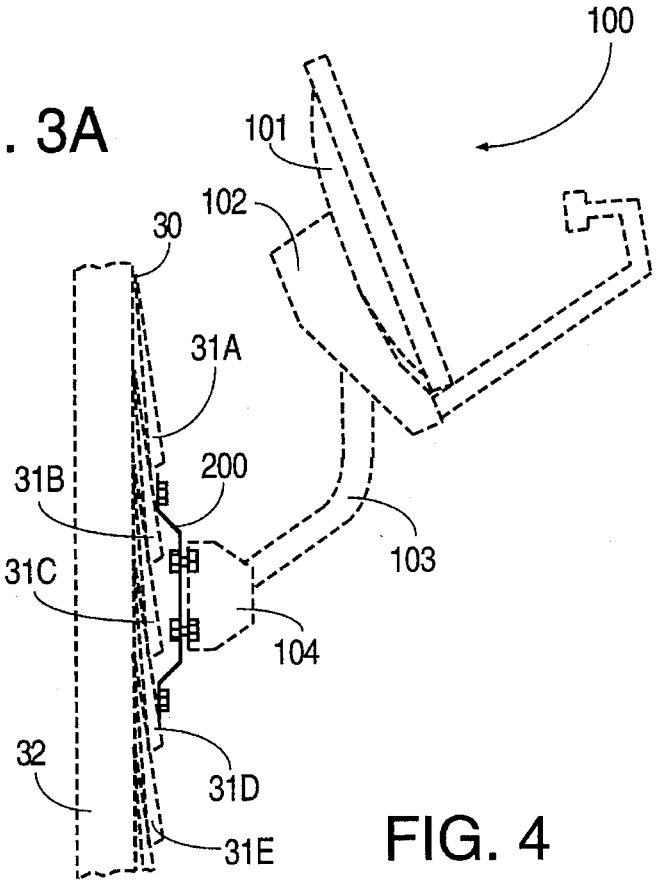
FIG. 4 illustrates the use of the bracket of FIGS. 3A and 3B to mount a small satellite dish on a south facing wall having an uneven surface.

If a south facing wall is available, satellite dish 100 can be mounted on the south facing wall as shown in FIG. 4. South facing wall 32 (FIG. 4) has sidings 31A, 31B, 31C, 31D, and 31E. Bridge portion 203 of bracket 200 is at a sufficient distance from wall 32 so as to avoid touching sidings 31B and 31C.

Bracket 200 has several advantages. Bracket 200 allows a satellite dish 100 to be mounted on a south facing wall, although such a wall has an uneven surface, such as stucco, aluminum siding, vinyl siding and a textured surface. Also, bracket 200 allows satellite dish 100 to be mounted over the rear roof eave, although the roof surface is uneven, as in the case of shingle and shake roof surfaces. Therefore, using a bracket 200, a satellite dish 100 can be mounted on a rear portion of the house, out of sight and out of the way from the front yard, thus preserving the aesthetic beauty of the front yard. Furthermore, bracket 200 provides increased strength and stability to a satellite dish 100 by using two studs of a house. Also, having two sets of studs support holes at 16 inches and 24 inches allows bracket 200 to fit standard roof and wall stud spacings. Furthermore, bracket 200 can be easily produced from a flat sheet of steel by a machine. Moreover, bracket 200 has a simple and stackable shape which permits compact storage and shipping of a set of identical brackets. Finally, bracket 200 is easily installed using standard ¼ inch lag bolts and tools available in a hardware store.

Although the present invention has been described in connection with the above described illustrative embodiment, the present invention is not limited thereto. For example, instead of having a bracket 200 bolted to mounting foot 104, bracket 200 and mounting foot 104 can be formed as a single integral piece. Also, instead of leg portions 202 and 204 being at 45° to the bridge portion 203, any angle can be used in accordance with this invention. Furthermore, bracket 200 can be made sufficiently long to be supported by four roof eave studs instead of two roof eave studs as described above. Moreover, bracket 200 can be made of any materials other than a sheet of flat steel, such as, for example, H3003—H16 aluminum of 0.16 inch thickness. Alternatively, bracket 200 can be made of a stamped sheet of thin metal with structural folds which reinforce the shape to compensate for the thinner metal. Various modifications and adaptations of the above discussed embodiment are encompassed by this invention as set forth in the appended claims.

I claim:

1. An apparatus comprising:

a building;

a mounting structure supported by said building, said mounting structure being attached to at least two support members of said building; and a satellite dish supported by said mounting structure;

wherein said mounting structure comprises:

a first foot portion supported by said building;

a second foot portion supported by said building;

a first leg portion integrally connected to said first foot portion;

a second leg portion integrally connected to said second foot portion; and a bridge portion integrally connected to said first leg portion and to said second leg portion, said first leg portion and said second leg portion elevating said bridge portion with respect to said first foot portion and said second foot portion, said bridge portion supporting said satellite dish;

wherein said building has a roof and each of said first foot portion and said second foot portion is supported by both a first roof eave stud of said building and a second roof eave stud of said building.

2. The apparatus of claim 1 wherein said satellite dish has a mounting foot, said apparatus further comprising a plurality of bolts, said mounting foot being attached to said bridge portion of said mounting structure by said plurality of bolts.

3. The apparatus of claim 1 wherein said satellite dish is mounted on a rear portion of said building.

4. The apparatus of claim 1 wherein the elevation of said bridge portion from said first foot portion is sufficient for said bridge portion to clear uneven portions of the surface of said building.

5. The apparatus of claim 1 wherein said mounting structure is formed of a sheet of material folded into a predetermined cross-sectional shape.

6. The apparatus of claim 1 wherein each of said leg portions, said foot portions and said bridge portion is substantially non-tubular.

7. The apparatus of claim 1 wherein each of said leg portions, said foot portions and said bridge portion is substantially flat.

8. The apparatus of claim 1 wherein each of said leg portions, said foot portions and said bridge portion is substantially rectangular.

9. The apparatus of claim 1 wherein each of said leg portions, said foot portions and said bridge portion is substantially flat and substantially rectangular.

10. An apparatus comprising:

a building;

a mounting structure supported by said building, said mounting structure being attached to at least two support members of said building; and a satellite dish supported by said mounting structure;

wherein said mounting structure is a single piece and comprises:

a first foot portion supported by said building;

a second foot portion supported by said building;

a first leg portion continuously and rigidly connected to said first foot portion;

a second leg portion continuously and rigidly connected to said second foot portion; and a bridge portion continuously and rigidly connected to said first leg portion and to said second leg portion, said first leg portion and said second leg portion elevating said bridge portion with respect to said first foot portion and said second foot portion, said bridge portion supporting said satellite dish;

further wherein said mounting structure is formed of a sheet of material folded into a predetermined non-tubular cross-sectional shape.

11. The apparatus of claim 10 wherein said building includes a wall and said first foot portion and said second foot portion are supported by a first wall stud of said building and a second wall stud of said building.

12. The apparatus of claim 1 wherein said satellite dish has a mounting foot, said apparatus further comprising a plurality of bolts, said mounting foot being attached to said bridge portion of said mounting structure by said plurality of bolts.

13. The apparatus of claim 12 wherein said plurality of bolts are located in a predetermined non-linear configuration with respect to each other.

14. The apparatus of claim 13 wherein said plurality of bolts are located at the four corners of a rectangle.

15. The apparatus of claim 1 wherein said satellite dish is mounted on a rear portion of said building.

16. An apparatus comprising:

a building;

a mounting structure supported by said building, said mounting structure being attached to at least two support members of said building; and a satellite dish supported by said mounting structure;

wherein said mounting structure comprises:

a first foot portion supported by said building;

a second foot portion supported by said building;

a first leg portion integrally connected to said first foot portion;

a second leg portion integrally connected to said second foot portion; and a bridge portion integrally connected to said first leg portion and to said second leg portion, said first leg portion and said second leg portion elevating said bridge portion with respect to said first foot portion and said second foot portion, said bridge portion supporting said satellite dish;

wherein each of said leg portions, said foot portions and said bridge portion has a flat rectangular shape.

17. The apparatus of claim 16 wherein each of said leg portions is at a selected angle measured from the plane of said bridge portion thereby to allow said mounting structure to be stackable with other such mounting structures.

18. The apparatus of claim 17 wherein each of said foot portions includes a plurality of holes and said apparatus further includes a plurality of fasteners located in said holes for coupling each of said foot portions to at least two studs of said building.

19. The apparatus of claim 18 having only two foot portions coupled to said building.

20. The apparatus of claim 19 wherein a first pair of said holes are separated from each other by a first distance, a second pair of said holes are separated from each other by a second distance and third pair of said holes are separated from each other by a third distance.

21. The apparatus of claim 19 wherein said plurality of holes are four in number.

* * * * *